US006435422B1

(12) United States Patent
Wutschik

(10) Patent No.: US 6,435,422 B1
(45) Date of Patent: Aug. 20, 2002

(54) FLOATING FOUNTAIN

(76) Inventor: Mark Wutschik, Kallenberger Str. 24, D-70825 Münchingen-Kallenberger (DE)

( * ) Notice: Subject to any disclaimer, the term of this patent is extended or adjusted under 35 U.S.C. 154(b) by 0 days.

(21) Appl. No.: 09/694,763

(22) Filed: Oct. 23, 2000

(30) Foreign Application Priority Data

Oct. 21, 1999 (DE) ..... 299 18 542 U

(51) Int. Cl.[7] ..... B05B 17/08
(52) U.S. Cl. ..... 239/23; 239/18
(58) Field of Search ..... 239/16–23

(56) References Cited

U.S. PATENT DOCUMENTS

| | | | | | |
|---|---|---|---|---|---|
| 3,088,675 | A | * | 5/1963 | Bone | 239/17 |
| 4,906,359 | A | * | 3/1990 | Cox, Jr. | 210/170 |
| 5,320,449 | A | * | 6/1994 | Demarteau | 405/79 |
| 6,179,218 | B1 | * | 1/2001 | Gates | 239/17 |

FOREIGN PATENT DOCUMENTS

| | | |
|---|---|---|
| DE | 15591 | 2/1955 |
| DE | 565 233 | 9/1960 |
| DE | 93 04 973 | 4/1994 |
| DE | 196 06 496 | 8/1997 |
| DE | 197 12 072 | 6/1998 |
| DE | 298 13 170 | 3/1999 |
| JP | 08196966 | 8/1996 |
| WO | 98/08617 | 3/1998 |

* cited by examiner

*Primary Examiner*—Lesley D. Morris
*Assistant Examiner*—Christopher Kim
(74) *Attorney, Agent, or Firm*—Pauley Petersen Kinne & Erickson

(57) ABSTRACT

A floating fountain having a sealed housing with a lower and an upper housing element, and having an electrical pump unit with required energy supplied by solar cells attached to the fountain. Manufacture and a permanently dependable operation are achieved because the upper housing element is designed as a cover which lets through light at least in partial areas and is applied to the lower housing element in a watertight manner. The solar cells are arranged in an interior of the housing so that the solar cells absorb light entering through the transparent cover.

13 Claims, 1 Drawing Sheet

FLOATING FOUNTAIN

BACKGROUND OF THE INVENTION

1. Field of the Invention

This invention relates to a floating fountain, having a sealed housing with a lower and an upper housing element, and having an electrical pump unit with energy supply solar cells attached to the fountain.

2. Description of Related Art

A floating fountain is disclosed by German Patent Reference DE 93 04 973 U1. With this known fountain, a floating island for a garden pond, a pump unit is placed into a lower housing element and is supplied with energy from solar cells, which also forms an upper housing element as a flat cover. In this case the exterior contours of the solar cell units are matched to the contours of the upper edge of the lower housing element. This matching is relatively elaborate and, if it is not performed carefully, can cause sealing problems.

OBJECT OF THE INVENTION

It is one object of this invention to provide a floating fountain in accordance with the species, which allows a simpler manufacture and a permanently dependable operation.

This object is achieved with an upper housing element designed as a cover, which lets through light at least in partial areas and is applied to the lower housing element in a watertight manner. The solar cells are arranged in the interior of the housing so that they absorb light entering through the transparent cover.

Essentially, the transparent cover of the upper housing element permits any arbitrary suitable shapes, wherein the connecting area can be exactly matched to the lower housing element by appropriate shaping, so that an exact fit and dependable seal results. Due to the design of the cover, liberal functional and visual design options result, to a large extent.

Various design options include the cover made, at least partially, of clear or frosted glass, or clear or frosted plastic material. Here, the embodiment with clear material provides a view of the interior of the housing, for example of the solar cells, and essentially leaves the entry of light unrestricted. But by using frosted glass it is possible to screen the housing interior against viewing from the outside, while the light for producing energy can be used almost completely. The frosted material can be selected such that a suitable dispersion indicatrix with forward dispersion onto the solar cells is assured.

Various suitable application options for the solar cells result from applying the solar cells directly to or at a distance from an underside of a covering, or on the lower housing element.

In one advantageous embodiment, the lower housing element is cup-shaped or pot-shaped and open toward the top. The cover is embodied as a flat disk. An upper circumferential edge of the lower housing element has a receptacle for a circumferential edge area or a circumferential sealing section formed thereon. In connection with the attachment and sealing, the receptacle is designed to be groove-shaped or step-shaped. Here, the individual embodiment can be such that the sealing section is embodied as a downward oriented strip, or as a groove, open at the bottom.

Suitable space for housing the pump unit and for arranging the solar unit and, if required, additional electrical or electronic components, for example a battery and control element, is obtained because the lower housing element has a bulge extending upward from its underside into the interior of the housing. The pump unit is arranged in the hollow space formed on the underside of the bulge, and the hollow space is closed by a cover. The pump unit is housed inside the bulge, wherein it is possible to supply the pump unit in a suitable manner with pump water through appropriate water inlet openings. The solar cells and, if required, further electronic components, are placed, protected against moisture, into the housing interior outside of the area of the bulge. Only the outlet of the water conveyed by the pump unit needs to be sealed, which is easily provided.

Moreover, for the sealed housing of the pump unit the step is advantageous. The pump unit is attached in a sealed manner in a pump housing with holding elements to the underside of the upper section of the bulge.

BRIEF DESCRIPTION OF THE DRAWINGS

This invention will be explained in greater detail in view of an exemplary embodiment and by making reference to the drawings wherein:

The single drawing FIGURE shows a flat design of a floatable fountain, in cross section.

DETAILED DESCRIPTION OF PREFERRED EMBODIMENTS

Figure 1:
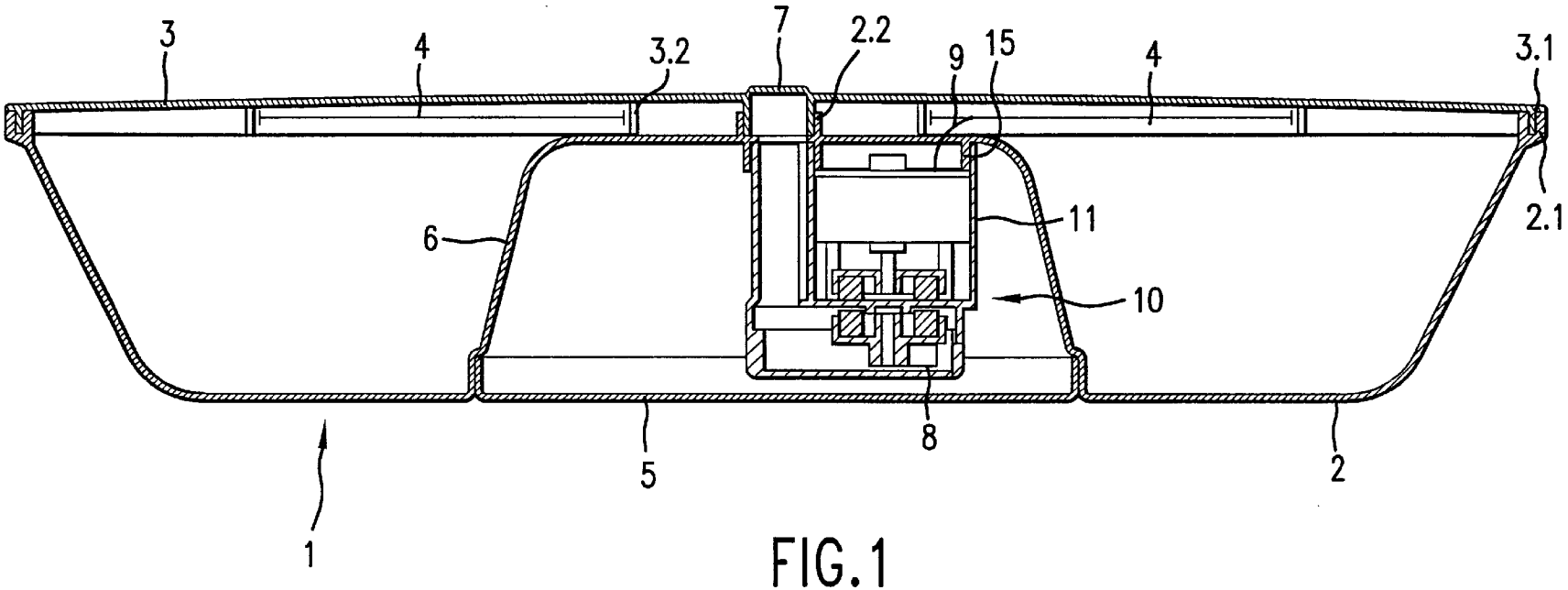

A lower housing element of the floatable fountain 1 is provided in a cup-like shape with an essentially flat bottom area and an upwardly pointing circumferential lateral wall. An upwardly pointing bulge 6 is provided in a lower area. On its circumferential free edge 2.1, the circumferential lateral wall has a groove-shaped receptacle, into which an upper housing element 3, in the shape of an essentially flat cover, is inserted with a circumferential strip-shaped sealing section 3.1 and can be additionally sealed against the penetration of moisture, for example by silicon or another suitable sealant.

The upper housing element 3, or respectively the cover, is transparent at least in some areas and made of clear or frosted glass or a plastic material. Solar cells 4, or respectively solar cell units, are attached underneath the transparent area on fastening elements 3.2 protruding from an underside of the cover.

In its upper part, the bulge 6 is essentially shaped flat, and extends up to the fastening elements 3.2, so that the upper section of the bulge 3 can simultaneously be used as a support for the cover 3. A passage for a water outlet opening 7 is provided in a center area of the upper section of the bulge 6, around which sealing elements 2.2, which protrude toward the outside and/or the inside, are arranged in a socket-like manner. The cover is connected with the sealing elements 2.2 by means of a matched and sealingly attachable further socket-like section in order to seal the outlet opening 7. A water feed conduit leading to the pump wheel of the pump unit 10 is connected to the sealing elements 2.2 provided on the underside, while the remaining portion of the pump unit 10 is placed into a watertight pump housing 11, which itself is attached tightly to the underside of the upper section of the bulge 6. The water to be pumped is introduced via a water inlet 8 into the chamber of the pump wheel, for which purpose appropriate openings, as well as further cover elements, are provided on the underside of the lower housing element 2. The bulge 6 is closed on its underside by means of a cover 5.

The solar cells 4 are connected to the pump unit 10 via an appropriate connector 9 for providing the pump unit 10 with energy. Further electronic components, not shown, such as a battery with appropriate electronic control components, can be arranged in the electrical connector 9. The further electronic components can be placed, protected against moisture, in the space formed outside of the bulge 6.

What is claimed is:

1. In a floating fountain having a sealed housing with a lower housing element (2) and an upper housing element (3), and having an electrical pump unit (10) with energy furnished by solar cells (4) attached to the fountain, the improvement comprising;

the upper housing element (3) designed as a cover which passes light at least in partial areas and is applied to the lower housing element (2) with a watertight seal, and the solar cells (4) arranged in an interior of the sealed housing so that the solar cells (4) absorb light entering through the partial areas of the upper housing element (3), the lower housing element (2) being one of cup-shaped and pot-shaped and open toward a top, and the upper housing element (3) embodied as a flat disk, and the watertight seal including an upper circumferential edge (2.1) of the lower housing element (2) having a receptacle for a circumferential sealing section (3.1) formed on the upper housing element (3).

2. In the fountain in accordance with claim 1, wherein the receptacle is groove-shaped.

3. In the fountain in accordance with claim 1, wherein the partial areas are formed, at least partially, of one of a clear glass, a frosted glass, a clear plastic material and a frosted plastic material.

4. In the fountain in accordance with claim 3, wherein the solar cells (4) are applied to an underside of the upper housing element (3).

5. In the fountain in accordance with claim 1, wherein the lower housing element (2) has a bulge (6) extending upward from an underside into the interior of the sealed housing, the pump unit (10) is arranged in a hollow space formed on an underside of the bulge (6), and the hollow space is closed off by a second cover (5).

6. In the fountain in accordance with claim 5, wherein the pump unit (10) is sealably attached in a pump housing (11) with holding elements (15) to the underside of the bulge (6).

7. In a floating fountain having a sealed housing with a lower housing element (2) and an upper housing element (3), and having an electrical pump unit (10) with energy furnished by solar cells (4) attached to the fountain, the improvement comprising:

the upper housing element (3) designed as a cover which passes light at least in partial areas and is applied to the lower housing element (2) with a watertight seal, and the solar cells (4) arranged in an interior of the sealed housing so that the solar cells (4) absorb light entering through the partial areas of the upper housing element (3), the lower housing element (2) having a bulge (6) extending upward from a bottom of the lower housing element (2) into an interior of the sealed housing and forming the watertight seal, the pump unit (10) being arranged in a hollow space formed on an underside of the bulge (6), and the hollow space being closed off by a second cover (5).

8. In the fountain in accordance with claim 7, wherein the pump unit (10) is sealably attached in a pump housing (11) with holding elements to the underside of the bulge (6).

9. In the fountain in accordance with claim 7, wherein the lower housing element (2) is cup-shaped and open toward a top, and the upper housing element (3) is embodied as a flat disk, and the watertight seal comprises an upper circumferential edge (2.1) of the lower housing element (2) has a receptacle for a circumferential sealing section (3.1) formed on the upper housing element (3).

10. In the fountain in accordance with claim 9, wherein the receptacle is groove-shaped.

11. In the fountain in accordance with claim 10, wherein the sealing section (3.1) is a downward oriented strip.

12. In the fountain in accordance with claim 3, wherein the sealing section (3.1) is a downward oriented strip.

13. In the fountain in accordance with claim 7, wherein the solar cells (4) are applied to an underside of the upper housing element (3).

* * * * *